US006883204B2

(12) United States Patent
Salice

(10) Patent No.: US 6,883,204 B2
(45) Date of Patent: Apr. 26, 2005

(54) HINGE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 56 days.

(21) Appl. No.: 10/157,615

(22) Filed: May 29, 2002

(65) Prior Publication Data

US 2004/0025293 A1 Feb. 12, 2004

(51) Int. Cl.[7] ..... E05D 7/04

(52) U.S. Cl. ..... 16/245; 16/236; 16/242; 16/382

(58) Field of Search ..... 16/238, 236, 235, 16/237, 242, 246, 265, 382, 245

(56) References Cited

U.S. PATENT DOCUMENTS

| | | | | | |
|---|---|---|---|---|---|
| 4,142,271 | A | * | 3/1979 | Busse | 16/238 |
| 5,500,983 | A | * | 3/1996 | Lautenschlager | 16/304 |
| 5,737,804 | A | * | 4/1998 | Ferrari et al. | 16/242 |
| 5,930,866 | A | * | 8/1999 | Rupprechter | 16/242 |
| 6,202,255 | B1 | * | 3/2001 | Sitter | 16/242 |
| 6,289,556 | B1 | * | 9/2001 | Salice | 16/335 |
| 6,360,401 | B1 | | 3/2002 | Salice | |
| 6,463,626 | B1 | * | 10/2002 | Ferrari et al. | 16/236 |
| 6,470,531 | B1 | * | 10/2002 | Domenig et al. | 16/240 |
| 6,523,225 | B1 | * | 2/2003 | Pecar | 16/382 |
| 6,615,452 | B1 | * | 9/2003 | Mueller et al. | 16/242 |

FOREIGN PATENT DOCUMENTS

| | | | | |
|---|---|---|---|---|
| DE | 2460127 A | * | 6/1976 | E05D/5/02 |
| DE | 2548153 A | * | 5/1977 | E05D/7/04 |
| DE | 4016664 A | * | 11/1991 | E05D/5/02 |
| DE | 29920945 | | 4/2001 | |
| DE | 10210017 C1 | * | 7/2003 | E05D/7/04 |
| JP | 409100670a | * | 4/1997 | E05D/7/04 |

* cited by examiner

*Primary Examiner*—Chuck Y. Mah
(74) *Attorney, Agent, or Firm*—Dilworth & Barrese LLP.

(57) ABSTRACT

The invention relates to a hinge, preferably a furniture hinge, comprising a hinge arm which is pivotally connected, at one end, via a joint axle to a hinge part and, at the other end, via holding means to a base element, preferably to a base plate. Provision is made in accordance with the invention for the holding means to comprise a first eccentric adjustment, preferably retained by friction, for displaceable holding which allows a displacement parallel to the joint axle.

16 Claims, 3 Drawing Sheets

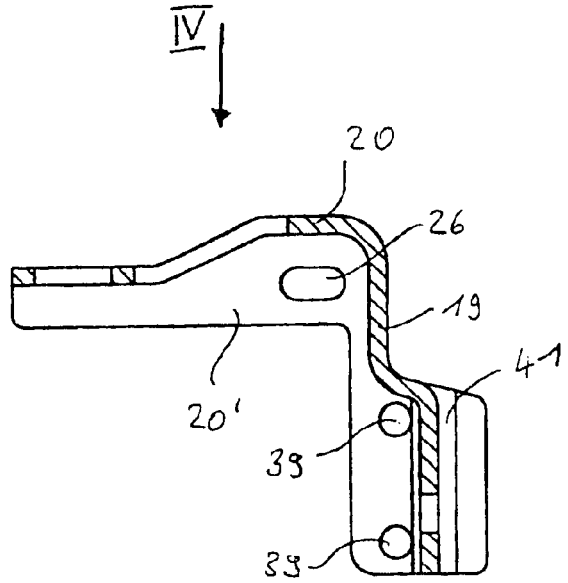
Figure3
Figure5
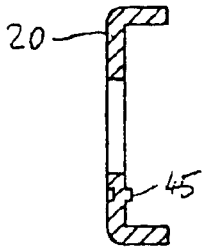
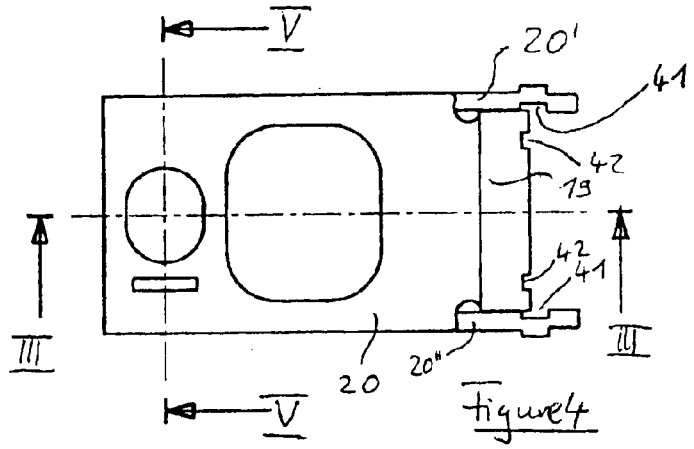
Figure4
Figure7
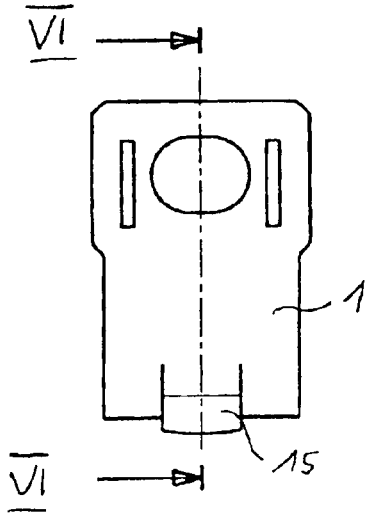
Figure6
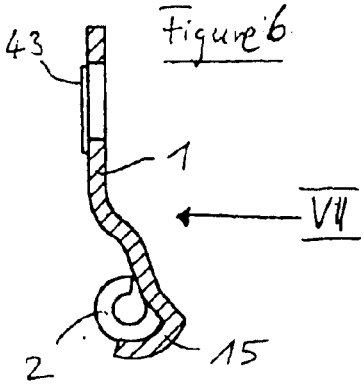

HINGE

BACKGROUND OF THE INVENTION

The invention relates to a hinge, preferably to a furniture hinge, comprising a hinge arm which is pivotally connected, at one end, via a joint axle to a hinge part and, at the other end, via holding means to a base element, preferably to a base plate.

Such a hinge of this kind is described in U.S. Pat. No. 6,360,401 B1. Such hinges are e.g. used for fastening door leaves to walls of pieces of furniture. With the hinge of the prior art, an unchangeable screw connection is provided between the hinge and the wall of the piece of furniture. A fastening would be desirable which allows a vertical adjustment of the hinge and thus of the door leaf with respect to the wall of the piece of furniture. For this purpose a fastening is provided in DE 299 20 945 U1 which allows a vertical displacement of the hinge along an elongate opening provided in a base plate of the hinge on the loosening of a fastening screw which serves the fastening of the hinge in the wall of the piece of furniture. The citation additionally describes the use of an eccentric adjustment for the displacement of the door leaf in the direction of the body of the piece of furniture in order to change the gap width between the door leaf and the body of the piece of furniture. The hinge described in DE 299 20 945 U1 has a mechanism which allows an adjustment of the door gap with the aid of the eccentric element independent of the vertical adjustment along the elongate opening. Complex uncoupling elements are required for this purpose.

SUMMARY OF THE INVENTION

It is the object of the present invention to provide a hinge which allows a simple adjustment to the height of the door leaf with respect to the body of the piece of furniture with a small installation size. This object is solved by a hinge having the features herein. Advantageous aspects also form the subject herein.

In accordance with the invention, the holding means comprise an eccentric adjustment for the displaceable holding of the hinge arm with respect to the base element which allows a displacement parallel to the joint axle.

Such an eccentric adjustment still allows a setting of the height of the hinge, and thus of the door of the piece of furniture with respect to the body, even after the installation. In this connection, the term "height" is used in the present context to make the invention understandable for the example of an upright door of a piece of furniture, e.g. of a closet. The invention can naturally equally be provided at flaps or other closing members. The term "height" is therefore understood here as that spatial direction in which the joint axle extends without this necessarily having to be aligned vertically in space.

The solution in accordance with the invention allows a low installation volume with a simultaneously very simple adjustment.

If the eccentric adjustment is moreover designed to be retained by friction, the operation is further simplified.

In an advantageous further development of the hinge in accordance with the invention, the holding means furthermore comprise a holding arm and a second eccentric adjustment which displaceably holds the hinge arm on the holding arm, with the second eccentric adjustment allowing a displacement perpendicularly to the displacement by the first eccentric adjustment. With the aid of such a second eccentric adjustment, the hinge is not only simply settable and alignable in "height", but also in a further spatial direction, with the setting even being able to be made after mounting. The second eccentric adjustment is also advantageously designed to be retained by friction.

In another further development, the holding means furthermore comprise an arm section which is displaceably held at the holding arm by a third eccentric adjustment, with the third eccentric adjustment allowing a displacement in each case substantially perpendicular to the displacement of the first and second eccentric adjustments. In this aspect, a simple setting of the hinge is also possible after mounting in all three spatial directions, with the installation space being kept low.

In a special embodiment, the first eccentric adjustment is provided in that part of the arm section which is remote from the third eccentric adjustment and serves the connection of the arm section to a base plate. This base plate serves e.g. the fastening of the hinge to the body of the piece of furniture. In such a further development, the hinge arm, which is e.g. connected to the door leaf, is connected to a base plate, which is e.g. fastened to the piece of furniture, via three eccentric adjustments.

The hinge in accordance with the invention of this embodiment preferably has a guide in the base plate which is arranged parallel to the joint axle and cooperates with guide elements of the arm section for guiding parallel to the joint axle. It is ensured by such a guide that no canting occurs when the hinge "height" is adjusted.

A simple aspect provides that the guide is formed by slits in the base plate in which the guide lugs of the arm section engage to allow only a movement between the arm section and the base plate parallel to the joint axle.

An additional holding action can be produced if the holding arm, the arm section and the base plate respectively have eye-like elements which are supported on an individual transverse pin. This common holding pin ensures a reliable mutual alignment of the individual elements with a low construction size.

To further reduce the size of the hinge in accordance with the invention, provision can advantageously be made for the individual sections to be unreleasably connected to one another via riveted eccentric elements.

The hinge in accordance with the invention can be made very small and compact and is therefore in particular suitable for use in pieces of furniture with frames. The clearance is greatly reduced in size with respect to the known hinges and only a low space is required for the fastening. An embodiment of the invention therefore relates to a hinge for pieces of furniture with a frame which is small in construction or compact.

BRIEF DESCRIPTION OF THE DRAWINGS

The invention will be explained in detail with reference to an embodiment which is shown in the Figures.

FIG. 3: a section through the holding arm of the hinge in accordance with FIGS. 1, 2;

FIG. 4: a plan view of the holding arm in direction IV of FIG. 3, with III designating the section which is visible in FIG. 3;

FIG. 5: a transverse cross-section along the plane V of FIG. 4;

FIG. 6: a section through the hinge arm of the hinge in accordance with the invention of FIGS. 1, 2;

FIG. 7: a plan view of the hinge arm of FIG. 6 in the direction of gaze VII, with VI designating the section which is visible in FIG. 6;

DESCRIPTION OF THE PREFERRED EMBODIMENTS

Figure 1:
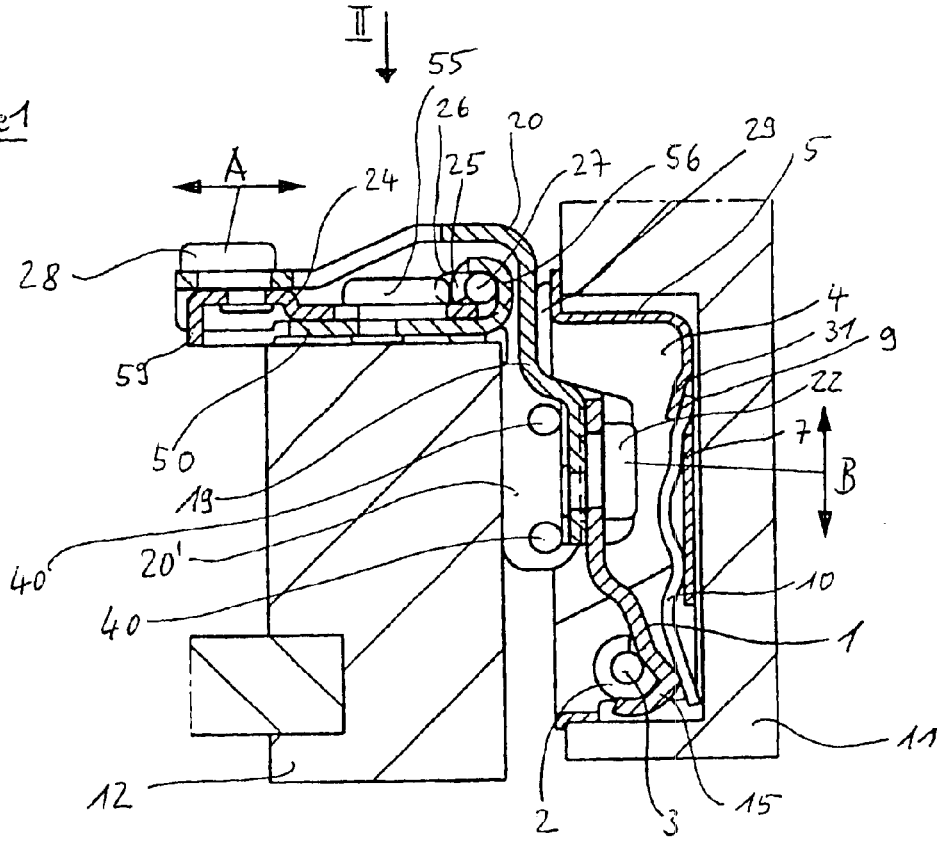
FIG. 1: a longitudinal section through a hinge in accordance with the invention in the closed state.
Figure 2:
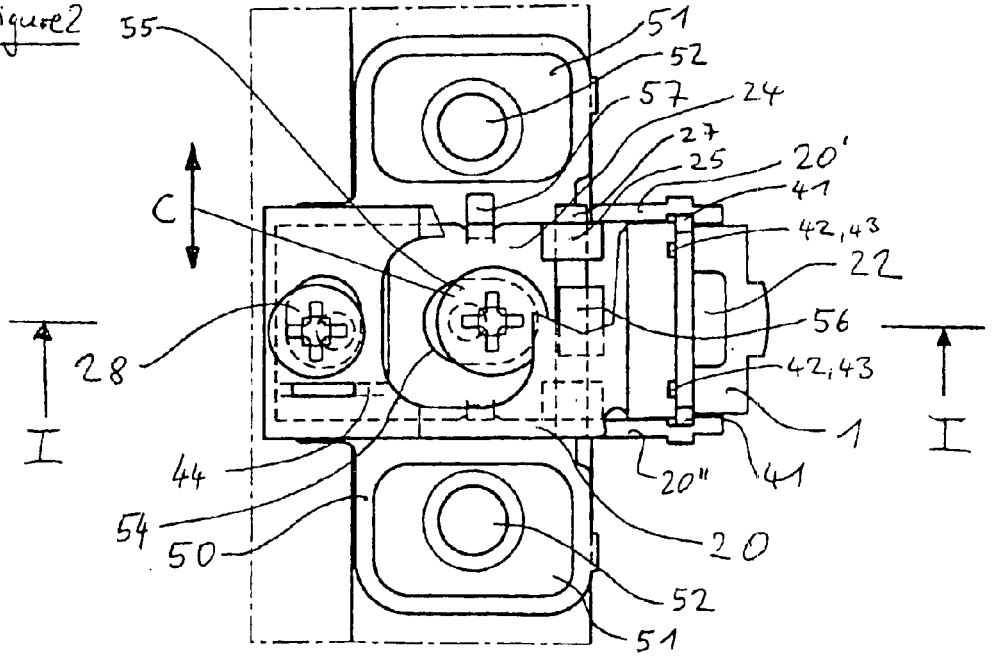
FIG. 2: a plan view of the part of the hinge on the side of the body of the piece of furniture in the direction II of FIG. 1, with that section being designated by I which is visible in FIG. 1.
Figure 8:
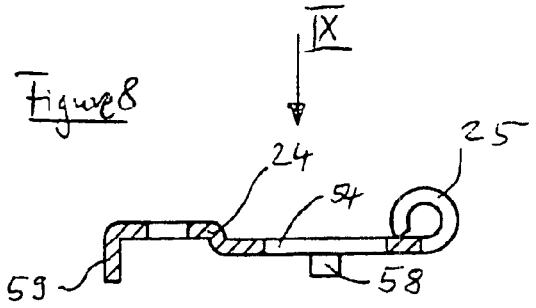
FIG. 8: a section through an arm section of the hinge in accordance with the invention of FIGS. 1, 2.

The hinge visible from FIGS. 1 and 2 consists of a hinge arm 1 provided with a bend, said hinge arm 1 enclosing with its lower rolled-in end 2 a joint axle 3 which, so to say, forms a bearing bore for this. The joint axle 3 is undisplaceably supported in a usual manner in the side walls of the pot-shaped hinge part 4. A tongue 31 is bent out of the base 7 of the pot-shaped hinge part 4 by a corresponding free cut. A slit is thereby formed in the base 7 into which the rear end 9 of a plate spring 10 is inserted. A cam 15 is bent out of the rolled-in part 2 of the hinge arm 1 and forms the lever arm for the plate spring 10. The pot-shaped hinge part 4 is inserted in a usual manner into a shallow blind aperture bore, for example of a door 11 of a piece of furniture and connected to this by a flange 29 which is part of the pot-shaped hinge part 4.

The hinge arm 1 is connected to the end face 19 of the holding arm 20 via an eccentric element 22 in a manner known per se to the holding arm 20. The holding arm 20 has a bend which is achieved in that the cut free side walls 20', 20" are angled and held against the center end face 19 by two transverse pins 40 riveted in associated bores 39. The front end regions of the side walls 20', 20" are provided with ridges 41 parallel to the frame, consisting of stamped bulges and forming guides for the hinge arm 1. Corresponding grooves 42 are provided in the end face 19 of the holding arm 20 in which corresponding ribs 43 of the hinge arm formed by bulging are guided.

The eccentric element 22 is designed such that its turning, e.g., with a screwdriver, effects the side setting in the direction of the arrow B along the ridges 41 or the grooves 42.

Figure 10:
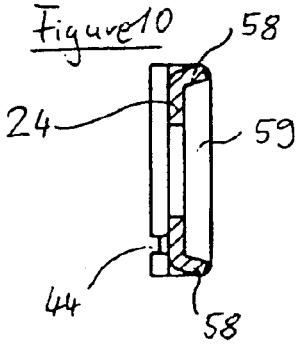
FIG. 10: a section along the plane X of FIG. 9.
Figure 9:
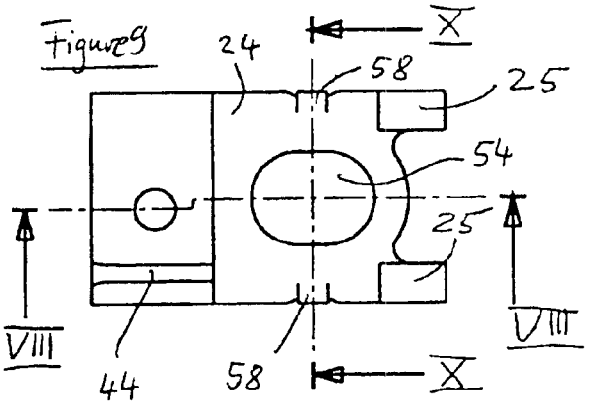
FIG. 9: a plan view in the direction IX of FIG. 8, with VIII designating the section which is visible in FIG. 8.
Figure 12:
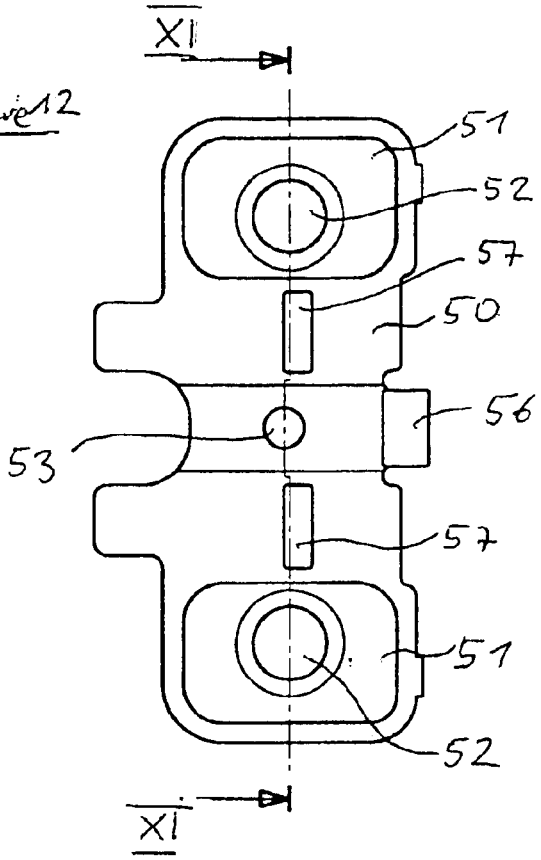
FIG. 12: a plan view of the base plate of FIG. 11 in the direction XII of FIG. 11, with XI designating the section which is visible in FIG. 11.
Figure 11:
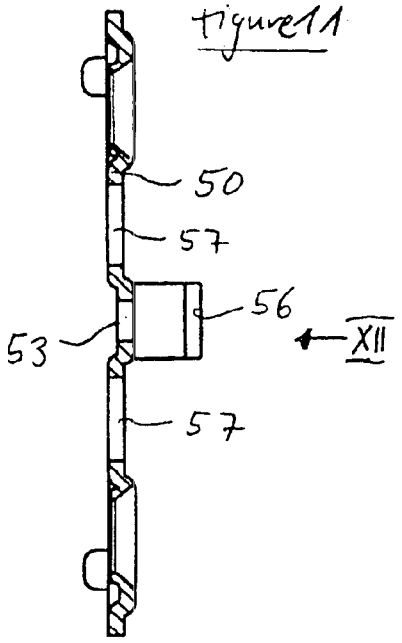
FIG. 11: a section through a base plate of a hinge in accordance with the invention of FIGS. 1, 2.

The end of the holding arm 20 remote from the connection to the hinge arm 1 is connected to the arm section 24 by the eccentric element 28 such that a turning of the eccentric element causes the depth setting in the direction of the arrow A. A guiding of this movement is ensured by the ridge 44 of the arm section 24 and the correspondingly formed rib 45 of the holding arm 20 such as are best visible in FIGS. 5 and 10.

The arm section 24 is provided at both sides at the end remote from the eccentric adjustment 28 with rolled in eyes 25 which hold a transverse pin 27 in the manner of an eyelet. This transverse pin 27 moreover passes through elongate openings 26 provided in the side walls 20', 20" of the holding arm 20.

The arm section 24 is connected to the base plate 50 via an eccentric adjustment 55. For this purpose, a central bore 53 is provided in the base plate 50. The eccentric shaft of the eccentric element 55, whose adjoining shaft part is supported in an elongate opening 54 of the arm section 24 and whose turning causes the vertical adjustment in the direction of the arrow C, is riveted into said central bore 53.

In its front central region, the base plate 50 is provided with an upwardly curved, partly rolled in tongue 56 which engages over the transverse pin 27 like a hook in the installed state. This tongue 56 improves the holding and the guiding of the arm section 24 at the base plate 50. The base plate is furthermore provided with slits 57 which form guides for lateral, downwardly bent lugs 58 of the arm section 24. These transversely extending slits and the bent lugs 58 prevent any canting between the arm section 24 and the base plate 50. A further guide of the arm section 24 during the eccentric adjustment in the direction C is formed by the angled rim 59.

The base plate 50 is finally fitted with leaf parts 51 which are connected, e.g. to a wall 12 of a piece of furniture, with usual fastening screws through the fastening bores 52.

The hinge therefore comprises a hinge arm 1 which is displaceably connected to a holding arm 20 in direction B via an eccentric connection 22. This holding arm 20 is displaceably connected to an arm section 24 in direction A via an eccentric connection 28, said arm section 24 in turn being displaceably connected to the base plate 50 in direction C via an eccentric connection 55. Guides 41, 42 are provided for the displacement in direction B made possible by the eccentric element 22 and the hinge arm 1, or ribs 43 provided thereon, engage into them. For the guiding of the movement which is made possible with the aid of the eccentric element 28 in the direction A, a rib 45 is provided in the holding arm 20 which guidingly engages into the ridge 44 of the arm section 24. Finally, the bent lugs 58 of the arm section 24 engage into slits 57 of the base plate for the guiding of the movement which is made possible by the eccentric element 55 in direction C. This movement is furthermore stabilized by the angled rim 59 of the arm section 24.

The base plate 50, the holding arm 20 and the arm section 24 are held at the transverse pin 27 via the tongue 56, the elongate openings 26 or the eyes 25, whereby the stability of the hinge is ensured and, specifically, the guide in the movement of the arm section 24 is additionally guided in direction C with respect to the base plate 50.

When riveted eccentric elements are used which form an unreleasable connection, the installation shape can be kept very small.

What is claimed is:

1. A hinge, comprising a hinge arm (1), a hinge part (4), a joint axle (3) pivotally connecting one end (2) of said hinge arm (1) to said hinge part (4), a base element (50), and holding means (20, 22, 24, 28, 55) captively connecting an opposite end of said hinge arm (1) to said base element (50), wherein said holding means (20, 22, 24, 28, 55) comprise a holding arm (20), a separately-formed arm section (24) and a first eccentric adjustment (28), with said holding arm (20) displaceably retained upon said arm section (24) through said first eccentric adjustment (28)

to permit adjustment of said hinge arm (1) in a direction (A) substantially perpendicular to the joint axle (3), and a second eccentric adjustment (55) displaceably retaining said hinge arm (1) to permit displacement of said hinge arm (1) in a direction (C) substantially parallel to the joint axle (3).

2. The hinge of claim 1, wherein said second eccentric adjustment (55) is unreleasably riveted to said base element (50).

3. The hinge of claim 1, wherein said hinge arm (1) is displaceably connected to said holding arm (20) through a third eccentric adjustment (22) to be movable in a direction (B) substantially perpendicular to both the displacement directions (C, A) substantially parallel and perpendicular to the joint axle (3).

4. The hinge of claim 3, wherein said eccentric adjustments (55, 22, 28) are structured and arranged to be retained in place by friction.

5. The hinge of claim 3, wherein said eccentric adjustments are unreleasably riveted to the respective holding arm, arm section, and base element to form a single hinge unit for installation.

6. A hinge comprising a hinge arm (1), a hinge part (4), a joint axle (3) pivotally connecting one end (2) of said arm (1) to said hinge part (4), a base element (50), and holding means (20, 22, 24, 28, 55) captively connecting an opposite end of said hinge arm (1) to said base element (50), wherein said holding means (20, 22, 24, 28, 55) additionally comprise a holding arm (20) and first eccentric adjustment (22), with said hinge arm (1) displaceably retained upon said holding arm (20) through said first eccentric adjustment (22) to permit displacement of said hinge arm (1) in a direction (B) substantially perpendicular to the joint axle (3), and a second eccentric adjustment (55) displaceably retaining said hinge arm (1) to permit displacement of said hinge arm (1) in a direction (C) substantially parallel to the joint axle (3).

7. The hinge of claim 6, wherein said first eccentric adjustment (22) is structured and arranged to be retained in place by friction.

8. The hinge of claim 6, wherein said second eccentric adjustment (55) is also structured and arranged to be retained in place by friction.

9. The hinge of claim 6, wherein said holding means (20, 22, 24, 28, 55) additionally comprise an arm section (24) and a third eccentric adjustment (28), with said holding arm (20) displaceably retained upon said arm section (24) through said third eccentric adjustment (28) to permit adjustment of said hinge arm (1) in a direction (A) substantially perpendicular to both displacement directions (C, B) respectively permitted by said first and second eccentric adjustments (55, 22).

10. The hinge of claim 9, wherein said third eccentric adjustment (28) is also structured and arranged to be retained in place by friction.

11. The hinge of claim 9, wherein said base element (50) is formed as a base plate (50) at which said arm section (24) is displaceably held by said second eccentric adjustment (55).

12. The hinge of claim 11, wherein said base plate (50) additionally comprises at least one guide (56, 57) arranged to extend substantially parallel to the joint axle (3), and said arm section (24) additionally comprises guide elements (25, 58, 59) arranged to cooperate with said at least one guide (56, 57) of said base plate (50) for guiding said hinge arm (1) in the direction (C) substantially parallel to the joint axle (3).

13. The hinge of claim 9, wherein said second eccentric adjustment (55) is unreleasably riveted to said base element (50), said first eccentric adjustment (22) is unreleasably riveted to said hinge arm (1) and holding arm (20), and said third eccentric adjustment (28) is unreleasably riveted to said holding arm (20) and arm section (24).

14. The hinge of claim 6, wherein said second eccentric adjustment (55) is unreleasably riveted to said base element (50), and said first eccentric adjustment (22) is unreleasably riveted to said hinge arm (1) and holding arm (20).

15. A hinge, comprising a hinge arm (1), a hinge part (4), a joint axle (3) pivotally connecting one end (2) of said hinge arm (1) to said hinge part (4), a base element (50), and holding means (20, 22, 24, 28, 55) connecting an opposite end of said hinge arm (1) to said base element (50), wherein said holding means (20, 22, 24, 28, 55) comprise a first eccentric adjustment (55) displaceably retaining said hinge arm (1) to permit displacement of said hinge arm (1) in a direction (C) substantially parallel to the joint axle (3), a holding arm (20) and second eccentric adjustment (22), with said hinge arm (1) displaceably retained upon said holding arm (20) through said second eccentric adjustment (22) to permit displacement of said hinge arm (1) in a direction (B) substantially perpendicular to the displacement direction (C) permitted by said first eccentric adjustment (55), an arm section (24) and a third eccentric adjustment (28), with said holding arm (20) displaceably retained upon said arm section (24) through said third eccentric adjustment (28) to permit adjustment of said hinge arm (1) in a direction (A) substantially perpendicular to both displacement directions (C, B) respectively permitted by said first and second eccentric adjustments (55, 22), said base element (50) is formed as a base plate (50) at which said arm section (24) is displaceably held by said first eccentric adjustment (55) and additionally comprises at least one guide (56, 57) arranged to extend substantially parallel to the joint axle (3), said arm section (24) additionally comprises guide elements (25, 58, 59) arranged to cooperate with said at least one guide (56, 57) of said base plate (50) for guiding said hinge arm (1) in the direction (C) substantially parallel to the joint axle (3), and said at least one guide is constituted by slits (57) arranged substantially parallel to the joint axle (3) in said base plate (50), and said guide elements comprise guide lugs (58) of said arm section (24) structured and arranged to engage in said slits (57) to allow only movement between said base plate (50) and arm section (24) substantially parallel (C) to the joint axle (3).

16. A hinge, comprising a hinge arm (1), a hinge part (4), a joint axle (3) pivotally connecting one end (2) of said hinge arm (1) to said hinge part (4), a base element (50), and holding means (20, 22, 24, 28, 55) connecting an opposite end of said hinge arm (1) to said base element (50), wherein said holding means (20, 22, 24, 28, 55) comprise a first eccentric adjustment (55) displaceably retaining said hinge arm (1) to permit displacement of said hinge arm (1) in a direction (C) substantially parallel to the joint axle (3), a holding arm (20) and second eccentric adjustment (22), with said hinge arm (1) displaceably retained upon said holding arm (20) through said second eccentric adjustment (22) to permit displacement of said hinge arm (1) in a direction (B) substantially perpendicular to the displacement direction (C) permitted by said first eccentric adjustment (55), an arm section (24) and a third eccentric adjustment (28), with said holding arm (20) displaceably retained upon said arm section (24) through said third eccentric adjustment (28) to permit adjustment of said hinge arm (1) in a direction (A) substantially perpendicular to both displacement directions (C, B) respectively permitted by said first and second eccentric adjustments (55, 22), said base element (50) is formed as a base plate (50) at which said arm section (24) is displaceably held by said first eccentric adjustment (55) and additionally comprises at least one guide (56, 57) arranged to extend substantially parallel to the joint axle (3), said arm section (24) additionally comprises guide elements (25, 58, 59) arranged to cooperate with said at least one guide (56, 57) of said base plate (50) for guiding said hinge arm (1) in the direction (C) substantially parallel to the joint axle (3), said holding arm (20), arm section (24) and base plate (50) have eye-like elements (26, 25, 56), and additionally comprising a common transverse pin (27) on which said eye-like elements (26, 25, 56) are arranged to be mounted.

* * * * *